United States Patent [19]

Stritzl et al.

[11] Patent Number: 4,861,064

[45] Date of Patent: Aug. 29, 1989

[54] SKI SAFETY BINDING

[75] Inventors: Karl Stritzl, Vienna; Hubert Wurthner, Hainburg/Donau; Andreas Riegler, Vienna, all of Austria

[73] Assignee: TMC Corporation, Barr/Zug, Switzerland

[21] Appl. No.: 153,825

[22] PCT Filed: May 14, 1987

[86] PCT No.: PCT/EP87/00254

§ 371 Date: Jan. 6, 1988

§ 102(e) Date: Jan. 6, 1988

[87] PCT Pub. No.: WO87/07516

PCT Pub. Date: Dec. 17, 1987

[30] Foreign Application Priority Data

Jun. 6, 1986 [AT] Austria ..... 1544/86

[51] Int. Cl.[4] ..... A63C 9/08

[52] U.S. Cl. ..... 280/618; 280/634

[58] Field of Search ..... 280/617, 618, 631, 633, 280/626, 628, 634

[56] References Cited

U.S. PATENT DOCUMENTS

| | | | |
|---|---|---|---|
| 3,432,179 | 3/1969 | Marker et al. | 280/618 |
| 3,966,218 | 6/1976 | Beyl | 280/618 |
| 4,135,735 | 1/1979 | Beyl | 280/634 X |
| 4,190,264 | 2/1980 | Himmetsberger et al. | 280/618 |
| 4,269,431 | 5/1981 | Weigl | 280/618 |
| 4,274,653 | 6/1981 | Himmetsberger et al. | 280/618 |
| 4,277,083 | 7/1981 | Himmetsberger et al. | 280/618 |
| 4,288,094 | 9/1981 | Suoboda | 280/634 X |
| 4,302,027 | 11/1981 | Himmetsberger et al. | 280/633 X |
| 4,600,213 | 7/1986 | Sedlmair et al. | 280/618 |
| 4,624,475 | 11/1986 | Nowak et al. | 280/618 |
| 4,629,208 | 12/1986 | Gertsch et al. | 280/618 |
| 4,679,815 | 7/1987 | Pascal et al. | 280/618 |

FOREIGN PATENT DOCUMENTS

| | | | |
|---|---|---|---|
| 302130 | 10/1972 | Austria | 280/618 |
| 330632 | 7/1976 | Austria | 280/618 |
| 2510385 | 10/1975 | Fed. Rep. of Germany | 280/617 |
| 2421754 | 11/1975 | Fed. Rep. of Germany | 280/618 |
| 3421499 | 12/1984 | Fed. Rep. of Germany | 280/618 |
| 3342155 | 5/1985 | Fed. Rep. of Germany | 280/618 |
| 2198762 | 4/1974 | France . | |
| 2305208 | 7/1975 | France . | |
| 2279433 | 1/1982 | France . | |

OTHER PUBLICATIONS

WO 82/02495 8/5/82, "Safety Ski Binding", Inventor: Roland Jungkind.

*Primary Examiner*—Charles A. Marmor
*Assistant Examiner*—Brian L. Johnson
*Attorney, Agent, or Firm*—Finnegan, Henderson, Farabow, Garrett & Dunner

[57] ABSTRACT

The invention concerns a safety ski binding comprising a sole plate supported pivotally on a fixed pivot pin, a toe piece and a heel holder. The sole plate is secured both at the rear and at the front thereof against lifting off the ski. A base plate is provided at the front of the sole plate and functions as a guide for a guide plate moveable in the longitudinal direction of the ski. The sole plate is kept at the rear in the travel position by a spring-loaded locking member which engages a fastener.

5 Claims, 3 Drawing Sheets

SKI SAFETY BINDING

The invention concerns a ski safety binding.

Such a ski binding is essentially described in the Austrian Pat. No. 330,632. In the known solution, the locking member is designed in such a manner that the heel holder will be actuated in the presence of both excessive lateral forces and of those in the vertical plane. As a result, the toe piece can be made as a simple holding bail and therefore the ski shoe fastener can also become very simple in front of the sole plate. On the other hand, the known design suffers from the drawback that the sole plate is secured against lifting in the heel zone only by the cooperation between the spring-loaded compression part and the associated fastener fixed in the ski. Consequently, changes in the position of the sole plate, taking place during ski flexure over ground irregularities, will affect the release mechanism of the ski binding.

A further ski binding of this species is known from the German Offenlegungsschrift 33 42 155. In this known ski binding, these fasteners, fixed in the ski, partly overlap the sole plate both at its front and rear, thereby securing it against lifting off from the ski. As a result however, the sole plate may jam or stress in the fasteners during ski flexure. Also, the sole plate is made rigid for reasons of strength and thereby hampers ski flexure, which in turn adversely affects skiing properties.

The object of the present invention is to avoid the stated drawbacks and to prevent clamping the ski boot or the sole plate when the ski is moving over uneven terrain, for instance depressions.

This problem is solved by the features of the present invention.

By linking the sole plate to the guide plate, the sole plate is reliably guided in any of its positions and therefore clamping of the ski boot sole located on the sole plate is avoided. The support of the invention of the sole plate on the ski furthermore assures reliable fastening of the sole plate and freedom of motion between the sole plate and the ski when the latter bends. The continuous displaceability of the guide plate relative to the base plate fixed in the ski contributes further to that effect.

The step of mounting toe pieces of a safety binding to a sole plate is known, for instance from the Austrian Pat. No. 302,130. However, in this known design, the two toe pieces rest by their base plates directly on the sole plate, and one end of the sole plate is supported in longitudinally displaceably guided manner relative to a fastener fixed in the ski. The other end is rigidly joined to, or hinges on, the other fasterner fixed in the ski. This known embodiment incurs however the drawback that the plate must be continuously spaced from the ski top side between the two bearing places, entailing a greater construction height of the entire assembly. In another known design, disclosed in the German Offenlegungsschrift 34 21 499, the problem is to automatically pivot back, following lateral release, the sole plate both at the front and the rear, together with the toe piece and the heel holder, into the initial position, that is, into the travel position. As such solutions already had long been known from various designs of the state of the art and because the problem basic to the presently cited Offenlegungsschrift is remote from the goal of this invention, the disclosure of said Offenlegungsschrift is even farther afield from the object of this invention than the state of the art cited herein initially. Merely for the sake of completeness, reference is also made to the German Ofenlegungsschrift 34 21 499 and to the French Pat. Nos. 22 79 433; 21 98 762 and 23 05 208.

The present invention provides an especially simple but nevertheless effective design of the displaceable link between the sole and guide plates.

In a manner widely known, the toe piece might be supported directly on the guide plate in longitudinally displaceable manner along the guide rail. However it was found especially advantageous in this application to design the bearing of the toe piece according to another feature of the present invention, that is, being formed by the fore of the sole plate, whereby the part of the sole plate linking the guide plate is formed at the bearing.

The present invention further premits interference-free motion for any pivoting displacement of the sole plate relative to the guide plate in the longitudinal direction of the ski.

By supporting the sole plate on the pivot pin, the sole plate may tip relative to the pivot pin without danger of jamming.

Accordingly the overall design assures good and reliable ski guidance at any time and therefore also during ski flexure caused by the terrain particulars.

Further features, advantages and details of the invention are more comprehensively discussed in relation to the drawing showing an illustrative embodiment mode.

Figure 1:
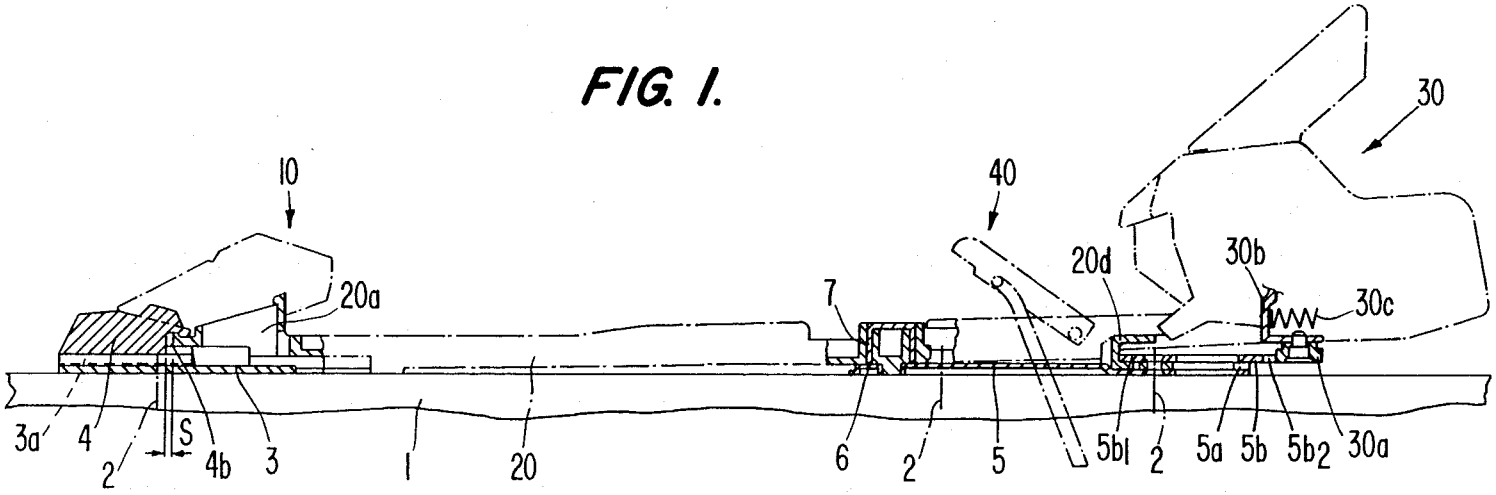
FIG. 1 shows a longitudinal section of parts of the invention.
Figure 2:
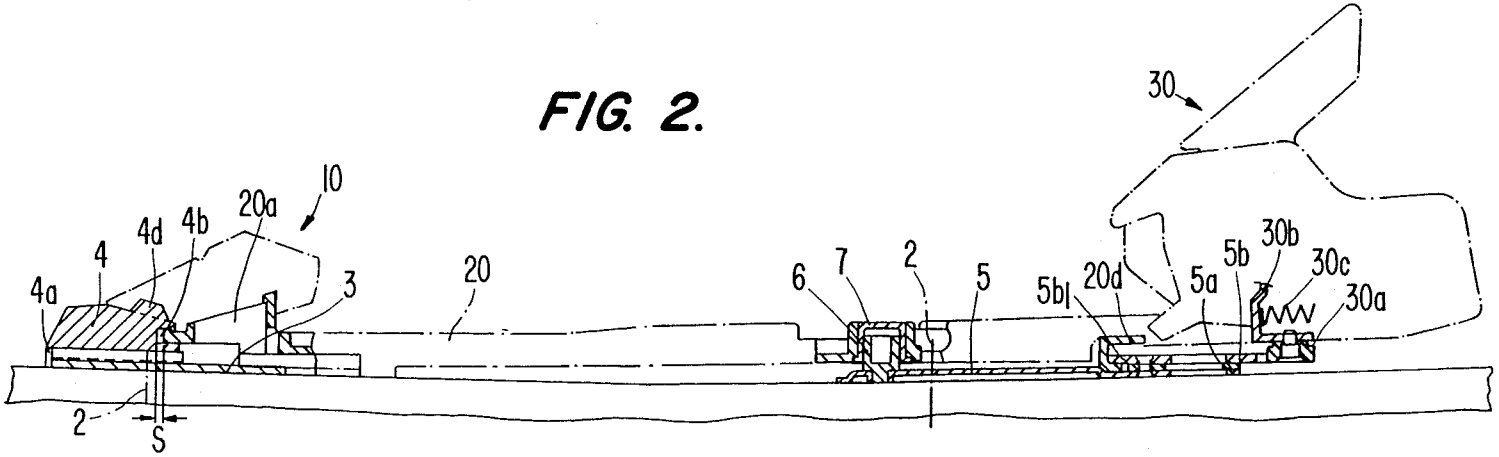
FIG. 2 shows the ski binding of FIG. 1 with a slightly flexured ski, the ski brake having been omitted.
Figure 3:
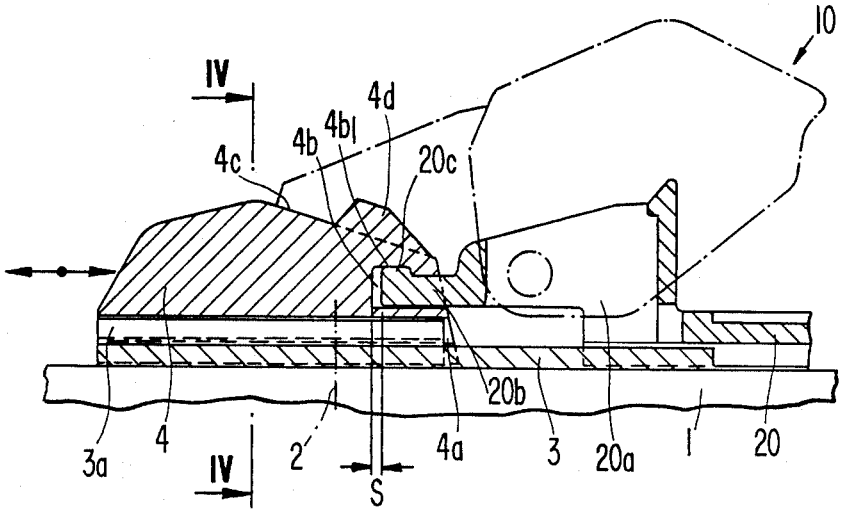
FIG. 3 is a longitudinal section on an enlarged scale of the fore of the ski binding

FIG. 1 shows a safety ski binding, to be described in further detail below, on a ski 1 on flat terrain and before being boarded. The parts indicated by dashed lines are outside the scope of this invention and are shown merely for better understanding. A base plate 3 for a toe piece 10 and an assembly plate 5 for a sole plate 20 pivotably supported in manner known per se on a pivot pin 6 are mounted on the ski 1 by merely indicated screws 2. The sole plate 20 further supports a heel holder 30 and a ski brake 40, which are of known designs and outside the scope of this invention and accordingly are not described in further detail. The pivot pin 6 is rigidly joined to the assembly plate 5 and supports, with an interposed bush 7, the sole plate 20. In the present embodiment, the bush 7 is rigidly set into the clearance of the sole plate 20. It consists of a low-friction plastic permitting tipping of the sole plate 20 relative to the pivot pin 6 without danger of jamming. In particular polyacetal is suitable as a plastic.

Figure 4:
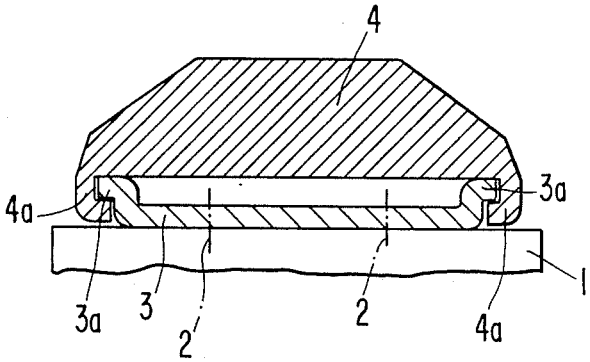
FIG. 4 is a section along line IV-IV of FIG. 3
Figure 5:
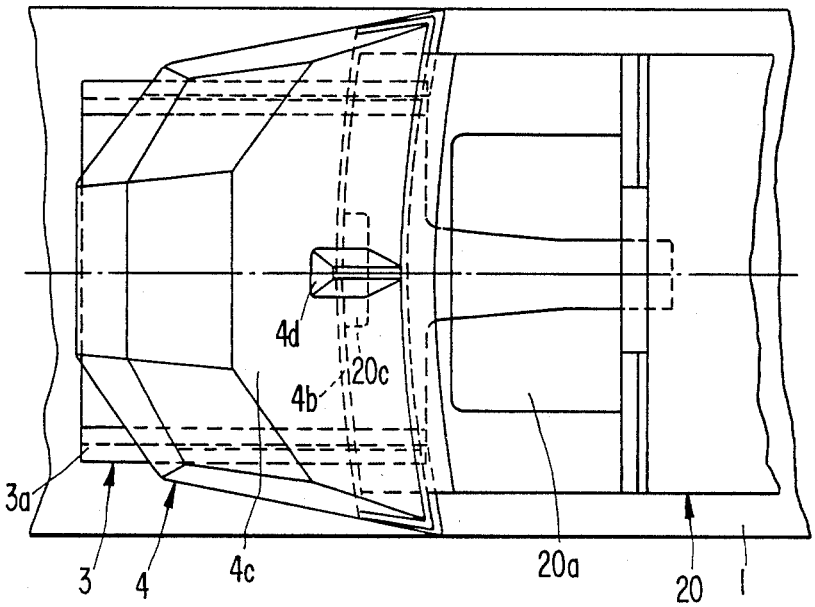
FIG. 5 shows a top plan view of the toe region.

The base plate 3 is equipped on both sides with upwardly projecting guide rails 3*a* extending in the longitudinal ski direction. A guide plate 4 rests in longitudinally displaceable manner on the base plate 3 but cannot lift off it, side pieces 4*a* of the guide plate 4 overlapping and engaging underneath the guide rails 3*a* of the base plate 3 (FIG. 4). A guide groove 4*b* parallel to the ski topside and essentially transverse to the ski axis is present at the boot-side end of the guide plate 4. At its front end, the guide groove 4*b* comprises an upward widening $4b_1$. The guide groove 4*b* and its upward widening $4b_1$ extend along an arcuate piece of which the center line is drawn along a circle of which the origin is located at the intersection of the longitudinal axis of the ski 1 and the axis of the pivot pin 6. A rearward and downward oblique guide surface 4*c* is present at the topside of the guide plate 4. A control beak 4*d* rises in the zone of the longitudinal axis of the guide surface 4*c*.

The front of the sole plate 20 acts as the bearing 20*a* for the toe piece 10 which is merely indicated here. The front end of the bearing 20*a* is an attachment 20*b* with upward 20*c*. The attachment 20*b* of the bearing 20*a* enters the guide groove 4*b* of the guide plate 4, whereby the upward part 20*c* of the attachment 20*b* extends into the widening $4b_1$ of the guide groove 4*b*. A slight play S exists between the upward part 20*c* and the widening $4b_1$.

The rear of the assembly plate 5 is a guide for the pivot plate 20. A spacer 5*a* and a control cam element 5*b* above it are rigidly joined, for instance riveted to the assembly plate 5. The front of the cam element 5*b* is a holding rail $5b_1$ and overlaps a cross-sectionally approximately U-shaped fastener 20*d* connected to the sole plate 20. The rear of the cam element 5*b* acts as a control cam $5b_2$ for the sole plate 20 and cooperates with a control roller 30*a* connected to the heel holder 30. The control roller 30*a* rests by its fastening 30*b* against a spring 30c of the heel holder 30 pushing it against the cam $5b_2$.

If now due to terrain unevenness the ski 1 flexes, then the guide plate 4 can glide forward along the guide rails 3*a* of the base plate 3 according to the amount of ski flexure, the sole plate 20 sliding upward by its bush 7 along the pivot pin 6. This prevents any clamping of the sole plate 20, ie, the flexure of ski 1 is assured according to the terrain particulars and thereby also good and reliable ski guidance at any time is provided. Permanent operational linkage between the sole plate 20 and the toe piece 10 on one hand, and the guide plate 4 on the other, is always assured, that is even when the sole plate 20 is being pivoted, namely because the L-shaped attachment 20*b* of the sole plate is guided in the guide groove 4*b* of the guide plate, the upwardly piece 20*c* of the L-shaped attachment 20*b* engaging the widening $4b_1$ of the guide groove 4.

The longitudinal displaceable support of the invention of the guide plate 4, together with an adjustment mechanism known per se of the sole plate 20, of one to three shoe sizes) without thereby requiring assembling again the ski binding, which would entail weakening the ski 1 on acount of additional boreholes.

The invention is not restricted to the embodiment shown. Further variations exist which are well within the scope of protection. Illustratively the bush also can be fixed to the pin. The spacer plate provided above the assembly plate also may be integral with the assembly plate and/or with the control cam element.

We claim:

1. A safety ski binding for a ski comprising:

a sole plate provided on the ski having at least one toe piece and a heel holder for holding a ski boot, said sole plate being retained in a travel position for skiing by a locking member movable against the force of a spring and engaging a fastener;

a pivot pin fixed in the ski about which said sole plate is pivotably supported and along which said sole plate can move vertically in a limited range;

securing means for securing said sole plate to the ski, said securing means including a guide plate, said guide plate being displaceably guided with respect to a base plate in the longitudinal direction of the ski;

wherein the front of said sole plate functions as a link means with said guide plate for allowing displacement in the longitudinal direction of the ski; and said sole plate including an upwardly projecting part engageable with a guide groove provided in said guide plate, said guide groove including an upwardly widened portion and extending essentially transversely to the longitudinal direction of the ski.

2. The safety ski binding as defined in claim 1 wherein a bearing, having a front end zone, is provided at the front of said sole plate for supporting said toe piece, said front end zone of said bearing including an attachment having an upwardly projecting part for engaging said guide plate.

3. The safety ski binding as defined in claim 1, wherein a bush element, formed of a low-friction elastic plastic, cooperates with the pivot pin to prevent jamming thereof.

4. A safety ski binding, as defined in claim 1, wherein: said guide groove and said upwardly projecting part of the sole plate are arcuately shaped.

5. The safety ski binding, as defined in claim 1, wherein said guide groove is structured large enough such that a gap remains upon instruction of said attachment of said front end zone so as to allow play along the longitudinal direction of the ski thereby allowing use on varied terrain.

* * * * *